United States Patent [19]

Ammann et al.

[11] Patent Number: 4,803,716

[45] Date of Patent: Feb. 7, 1989

[54] X-RAY DIAGNOSTICS INSTALLATION FOR RADIOGRAPHS

[75] Inventors: Ernst Ammann, Bubenreuth; Paul Marhoff, Erlangen, both of Fed. Rep. of Germany

[73] Assignee: Siemens Aktiengesellschaft, Berlin and Munich, Fed. Rep. of Germany

[21] Appl. No.: 75,995

[22] Filed: Jul. 21, 1987

[30] Foreign Application Priority Data

Jul. 31, 1986 [DE] Fed. Rep. of Germany ..... 3625856

[51] Int. Cl.[4] ..... G21K 1/02

[52] U.S. Cl. ..... 378/155; 378/97; 378/154

[58] Field of Search ..... 378/155, 154, 97

[56] References Cited

U.S. PATENT DOCUMENTS 4,096,391 6/1978 Barnes .
4,250,103 2/1981 Vatne et al. ..... 378/97
4,646,340 2/1987 Bauer .

FOREIGN PATENT DOCUMENTS 0093649 11/1983 European Pat. Off. .
0153750 9/1985 European Pat. Off. .
884148 7/1953 Fed. Rep. of Germany .
956013 1/1957 Fed. Rep. of Germany .

OTHER PUBLICATIONS

Siemens Brochure "Every Modern Radiographic Technique With The Mammomat", undated.

*Primary Examiner*—Carolyn E. Fields
*Assistant Examiner*—David P. Porta
*Attorney, Agent, or Firm*—Hill, Van Santen, Steadman & Simpson

[57] ABSTRACT

An x-ray diagnostics installation for radiographs has a secondary radiation grid disposed in front of a holder for x-ray film. The secondary radiation grid is moveable during an exposure. Control circuitry controls the speed of movement of the secondary radiation grid dependent on the anticipated exposure time, such that imaging of the lamellae of the secondary radiation grid on the x-ray film is reliably prevented for all exposure times.

1 Claim, 1 Drawing Sheet

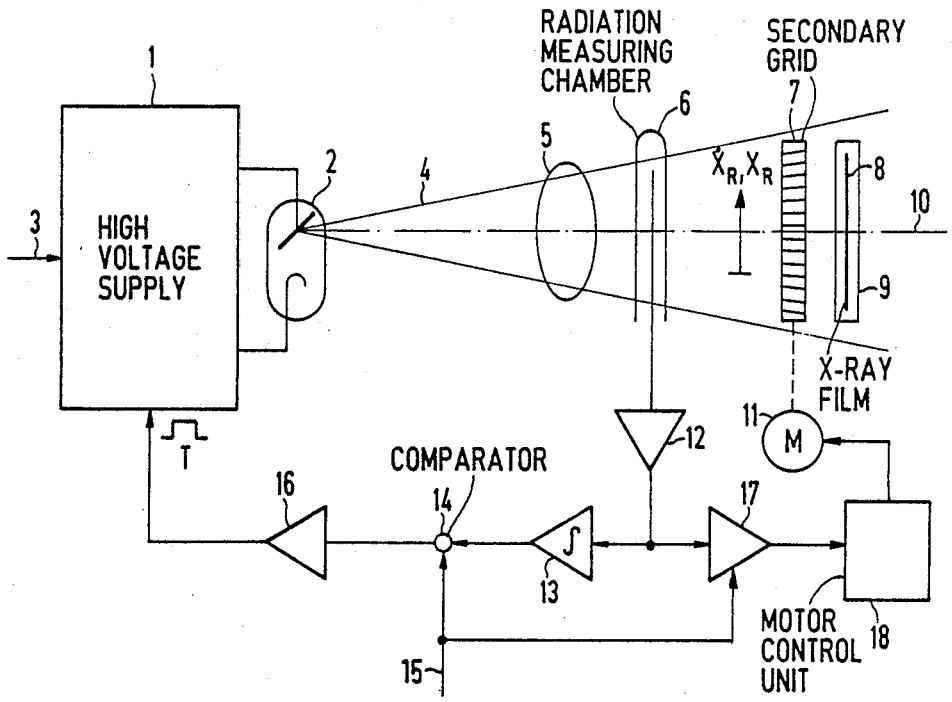
RADIATION
MEASURING
CHAMBER
SECONDARY
GRID
1
2
3
4
5
6
7
8
9
10
11
12
13
14
15
16
17
18
HIGH
VOLTAGE
SUPPLY
$X_R, X_R$
X-RAY
FILM
M
T
COMPARATOR
MOTOR
CONTROL
UNIT

X-RAY DIAGNOSTICS INSTALLATION FOR RADIOGRAPHS

BACKGROUND OF THE INVENTION

1. Field of the Invention

The present invention is directed to an x-ray diagnostics installation for radiographs, and in particular to such an x-ray installation having a secondary radiation grid preceding the film holder and means for moving the secondary radiation grid perpendicular to a central ray of the x-ray beam during an exposure.

2. Description of the Prior Art

X-ray diagnostics installation of the type described above are known which include means for forming an electrical signal corresponding to the exposure time, and control means for controlling the speed of movement of the secondary radiation grid dependent on the exposure time, with the speed of movement being fixed.

In x-ray diagnostics installations of this type, the secondary radiation grid has lamellae directed at the focus of the x-ray source for the purpose of suppressing leakage radiation emanating from the examination subject. The movement of the secondary radiation grid during an exposure is intended to prevent the lamellae from becoming visible in the resulting radiograph. In such known systems, the control circuitry for movement of the secondary radiation grid selects a rigidly prescribed rate of speed for such movement. It is not possible, however, using such a fixed speed to prevent grid streaks from becoming visible in the radiograph for all exposure times. As described in German Patent No. 884 148, the speed of the secondary radiation grid is set dependent on the exposure time, however, it is assumed that the exposure time is set before an exposure is actually undertaken, and is thus known. The system disclosed therein cannot undertake an automatic selection of the proper speed of movement of the secondary radiation grid without knowing the exposure time in advance.

SUMMARY OF THE INVENTION

It is an object of the present invention to provide an x-ray diagnostics installation of the type described above wherein imaging of the lamellae of the secondary radiation grid in the radiograph is reliably prevented for all exposure times by the use of an automatic exposure unit.

The above object is achieved in accordance with the principles of the present invention in an x-ray diagnostics installation having an automatic exposure means wherein a signal corresponding to the exposure time is acquired from the input signal of an integrator. The input signal to the integrator is obtained from a radiation measuring chamber disposed in the path of the x-ray beam after the examination subject. The radiation detector first supplies a dose rate signal which is used after integration for de-energizing the voltage supply for the x-ray source. Given a prescribed dose for an exposure, the anticipated exposure time can be calculated from the dose rate signal. A signal corresponding to the anticipated exposure time can then be used for controlling the rate of speed of the secondary radiation movement. The speed of movement of the secondary radiation grid must be increased with a shorter exposure time.

DESCRIPTION OF THE DRAWINGS

The single FIGURE is a schematic block diagram of an xray diagnostics installation constructed in accordance with the principles of the present invention.

DESCRIPTION OF THE PREFERRED EMBODIMENTS

A high voltage supply 1 is shown in the drawing which feeds an x-ray tube 2, and which is connected to the mains via a line 3. The x-ray tube 2 emits an x-ray beam 4 having a central ray indicated at 10. The x-ray beam 4 during a radiograph exposure penetrates an examination subject 5, passes through a radiation measuring chamber 6, passes through a secondary radiation grid 7, and is incident on an x-ray film 8 in an x-ray film cassette 9. During an exposure, the secondary radiation grid 7 is moved perpendicularly to the central ray 10 by a motor 11, so that the lamellae of the grid 7 which are directed at the focus of the x-ray tube 2, do not form an image on the film 8.

An electrical output of the radiation measuring chamber 6 is connected to an input of an integrator 13 through an amplifier 12. The output of the integrator 13 is an electrical signal corresponding to the actual value of the radiation dose, and is supplied to one input of a comparator 14. Another input of the comparator 14 is supplied with an electrical signal on a line 15 corresponding to the rated value of the radiation dose which is required for an optimum film blackening. When the actual value and the rated value of the radiation dose are the same, the comparator 14 supplies a signal to the high voltage supply 1 which de-energizes the supply and thus shuts off the x-ray tube 2.

The input signal of the integrator 13 (the current i) is proportional to the dose rate D. The exposure time is fixed by this signal. This signal is supplied through an amplifier 17 to a motor control unit 18 which controls the speed of the motor 11 and thus the speed of movement of the secondary grid 7. The signal on line 15 is also supplied to the amplifier 17 and controls the amplification factor thereof. The adjustment speed of the secondary radiation grid 7 is shown in the drawing as $\dot{X}_R$. This adjustment speed $\dot{X}_R$ will be higher as the anticipated exposure times becomes shorter.

The rated value and the actual value of the dose are calculated according to the following equation:

$$D_{rated} = D_{actual} = \int_0^T D_{actual}(t)\, dt;$$

wherein T is the exposure time, $D_{actual}$ is the actual value of the dose rate and t is real time.

The following relationship derives for the path $X_R$ traversed by the secondary radiation grid:

$$X_R = \int_0^T X_R(t)\, dt; \text{ and}$$

wherein $X_R$, as above, is the speed of the secondary radiation grid. This speed can be determined according to the following relationship:

$$X_R(t) = D_{actual}(t) \cdot \frac{X_R}{D_{rated}}.$$

The dose rate can be maintained constant during the exposure time, or may be a function of the time. According, $X_R$ is then constant or a function of time t.

For adequate blurring, a path distiance $X_R$ which the secondary radiation grid 7 must cover during an x-ray exposure is fixed. In order to avoid differences in optical density due to the secondary radiation grid 7 being off-centered, one half of the path distance $X_R$ is present on each side of the central ray 10.

Instead of controlling the speed of the secondary radiation grid as discussed above, a control circuit for this speed wherein the rated value is fixed dependent on the anticipated exposure tme may also be provided.

Although modifications and changes may be suggested by those skilled in the art it is the intention of the inventors to embody within the patent warranted hereon all changes and modifications as reasonably and properly come within the scope of their contribution to the art.

We claim as our invention:

1. An x-ray diagnostics installation comprising:

means for generating an x-ray beam having a central ray directed at an examination subject;

x-ray film disposed in the path of said x-ray beam after said examination subject for recording radiation from said means for generating attenuated by said examination subject;

means disposed between said examination subject and said x-ray film for generating an electrical signal corresponding to the exposure time;

a secondary radiation grid also disposed between said examination subject and said x-ray film having lamellae;

means for moving said secondary radiation grid perpendicularly with respect to said central ray of said x-ray beam; and control means for controlling the speed of movement of said secondary radiation grid dependent on said exposure time including means for integrating said signal corresponding to the exposure time, and wherein said signal corresponding to said exposure time is also supplied as a control signal for said means for moving said secondary radiation grid, such that the speed of said secondary radiation grid is controlled for all exposure times to avoid imaging said lamellae of said secondary grid on said x-ray film.

* * * * *